US007568986B2

(12) United States Patent
Watanabe et al.

(10) Patent No.: US 7,568,986 B2
(45) Date of Patent: Aug. 4, 2009

(54) GOLF BALL

(75) Inventors: Hideo Watanabe, Chichibu (JP); Junji Umezawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/882,216

(22) Filed: Jul. 31, 2007

(65) Prior Publication Data

US 2009/0036235 A1 Feb. 5, 2009

(51) Int. Cl.
*A63B 37/06* (2006.01)

(52) U.S. Cl. ..... 473/378

(58) Field of Classification Search ..... 473/378, 473/351

See application file for complete search history.

(56) References Cited

U.S. PATENT DOCUMENTS

| | | | | |
|---|---|---|---|---|
| 6,022,279 | A * | 2/2000 | Yamagishi et al. | 473/353 |
| 6,179,728 | B1 * | 1/2001 | Kashiwagi et al. | 473/356 |
| 6,435,984 | B1 | 8/2002 | Ohama | |
| 6,561,923 | B1 | 5/2003 | Ohama et al. | |
| 6,716,116 | B1 * | 4/2004 | Yokota | 473/378 |
| 6,729,976 | B2 * | 5/2004 | Bissonnette et al. | 473/383 |
| 6,825,272 | B2 * | 11/2004 | Fushihara et al. | 525/93 |

FOREIGN PATENT DOCUMENTS

| | | | |
|---|---|---|---|
| JP | 58-218977 | A | 12/1983 |
| JP | 60-088567 | A | 5/1985 |
| JP | 2000-24139 | A | 1/2000 |
| JP | 2000-254250 | A | 9/2000 |
| JP | 2004-033594 | A | 2/2004 |

* cited by examiner

*Primary Examiner*—Raeann Trimiew
(74) *Attorney, Agent, or Firm*—Sughrue Mion, PLLC

(57) ABSTRACT

The invention provides a two-piece golf ball having a single-layer core, a single-layer cover and a surface on which a plurality of dimples are formed. The cover is made of a material which includes 100 parts by weight of a resin material, from 0 to 0.5 part by weight of titanium oxide, and from 0.1 to 2 parts by weight of a fluorescent pigment selected from the group consisting of yellow, orange, peach and red. The ball surface has a lightness L value, expressed in the Lab color system, of at least 50. The core surface has an L value of at least 82 and a chroma C, defined as $(a^2+b^2)^{1/2}$, of 10 or less. The golf ball exhibits a brightly colored surface, is highly fashionable, and is readily visible during play.

14 Claims, 2 Drawing Sheets

GOLF BALL

BACKGROUND OF THE INVENTION

The present invention relates to a golf ball suitable for women golfers, which ball has a distinctive appearance, a soft feel on impact, and achieves a good distance on shots taken at a low head speed.

Most golf balls until now have been white. Recently, however, various stylish golf balls finished so as to give the ball a more attractive appearance have been disclosed in the art. Examples include the golf balls described in JP-A 58-218977, JP-A 60-88567, JP-A 2000-24139, JP-A 2000-254250 and JP-A 2004-33594. These prior-art golf balls have been obtained by including in the cover material an ingredient such as titanium oxide, a colored inorganic pigment, a fluorescent pigment or a fluorescent dye so as to render the ball into a colored ball.

However, although low L value colored balls having a fluorescent color such as orange or yellow do exist, they lack a sufficiently bright hue and thus are not sufficiently appealing to users.

A number of fluorescent colored balls in which the cover contains a fluorescent pigment have been described in the prior art. Yet, for various reasons, such as an insufficiently bright core or inappropriate compounding of the fluorescent pigment in the cover, the appearance of these balls leaves something to be desired.

It is therefore an object of the invention to provide a golf ball which has a distinctive appearance and is highly fashionable, making it useful particularly as a women's golf ball, yet also possesses a good flight performance and feel on impact.

SUMMARY OF THE INVENTION

As a result of extensive investigations, the inventor ultimately arrived at the following golf ball.

[1] A two-piece golf ball comprising a single-layer core, a single-layer cover and a surface on which a plurality of dimples are formed, wherein the cover is made of a material comprising 100 parts by weight of a resin material, from 0 to 0.5 part by weight of titanium oxide, and from 0.1 to 2 parts by weight of a fluorescent pigment selected from the group consisting of yellow, orange, peach and red, and wherein the ball surface has a lightness L value, expressed in the Lab color system, of at least 50 and the core surface has an L value of at least 82 and a chroma C, defined as $(a^2+b^2)^{1/2}$, of 10 or less.

[2] The golf ball of [1], wherein the core is made of a rubber composition comprising 100 parts by weight of a base rubber having a cis-1,4-polybutadiene content of at least 40 wt %, from 5 to 40 parts by weight of a metal salt of an unsaturated carboxylic acid, from 0.1 to 5 parts by weight of an organic peroxide, and from 10 to 40 parts by weight of an inorganic filler.

[3] The golf ball of [1], wherein the core contains rutile-type titanium oxide.

[4] The golf ball of [1], wherein the core is white.

[5] The golf ball of [2], wherein the inorganic filler present in the core is a combination of zinc oxide, precipitated barium sulfate, and titanium oxide.

[6] The golf ball of [1], wherein the core is made of a material which includes from 1 to 5 parts by weight of titanium oxide, from 1 to 10 parts by weight of zinc oxide and from 10 to 30 parts by weight of precipitated barium sulfate per 100 parts by weight of the base rubber, and the amount of zinc oxide is lower than the amount of titanium oxide.

[7] The golf ball of [1], wherein the cover has a material hardness, expressed as the Shore D hardness, of from 50 to 65, and a thickness of at least 1.2 mm.

[8] The golf ball of [1], wherein the fluorescent pigment included in the cover and the L value of the ball surface satisfies one of the following conditions:

(I) the fluorescent pigment has an orange color and the ball surface has an L value of at least 60;

(II) the fluorescent pigment has a peach color and the ball surface has an L value of at least 60;

(III) the fluorescent pigment has a yellow color and the ball surface has an L value of at least 90;

(IV) the fluorescent pigment has a red color and the ball surface has an L value of at least 50.

[9] The golf ball of [1], wherein the ball, when hit, has a coefficient of lift CL at a Reynolds number of 70,000 and a spin rate of 2,000 rpm that is at least 0.165, and a coefficient of drag CD at a Reynolds number of 180,000 and a spin rate of 2,520 rpm of at most 0.230.

One feature of the inventive golf ball is a core formulation which, in order to fully bring out the attractive appearance of the ball, achieves both core whiteness and a low cost. In addition, by judiciously selecting the resin material and fluorescent pigment for the cover that encloses the core and adjusting the contents thereof, it is possible, through synergistic effects between the surface colors of the core and the cover, to confer the ball with a bright, fluorescent color of a sort that has not previously been achieved. As a result, the ball is conspicuous in poor weather, such as during a snowfall, and has a distinctive appearance that makes it readily distinguishable from other colored golf balls. In addition to its excellent appearance, the ball can also be conferred with other desirable properties, such as a soft feel on impact and an improved distance.

BRIEF DESCRIPTION OF THE DIAGRAMS

DETAILED DESCRIPTION OF THE INVENTION

The invention is described more fully below.

Figure 1:
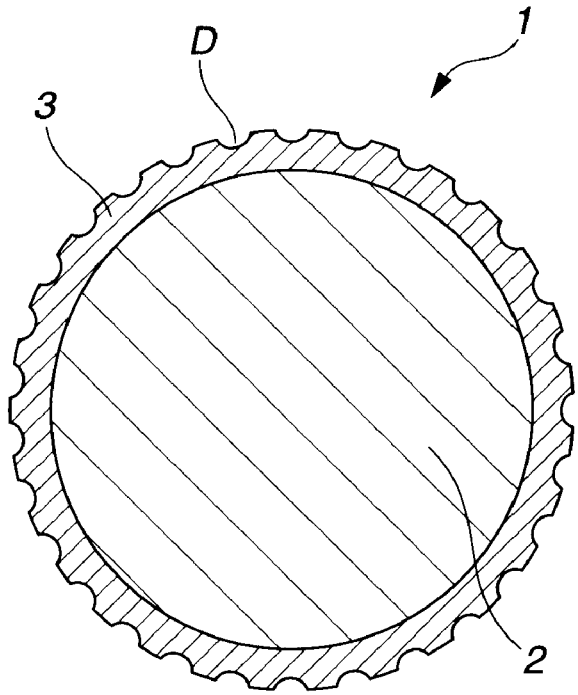
FIG. 1 is a schematic cross-sectional view of a golf ball illustrating an embodiment of the invention.

The golf ball of the invention is a two-piece ball composed of a single-layer core and a single-layer cover, and having a plurality of dimples on the surface of the ball. Specifically, as shown in the cross-sectional view of a golf ball 1 in FIG. 1, the ball has a two-layer construction composed of a core 2 encased within a single-layer cover 3. The symbol D in the diagram indicates the numerous dimples formed on the surface of the cover.

The above core may be formed of a known rubber material as the base material. A known base rubber such as natural rubber or synthetic rubber may be used as the base rubber. More specifically, it is recommended that primary use be made of polybutadiene, and especially 1,4-cis polybutadiene having a cis structure of at least 40%. If desired, natural rubber, polyisoprene rubber, styrene-butadiene rubber or the like may also be used together with the above-described polybutadiene in the base rubber.

Other ingredients, such as co-crosslinking agents (e.g., unsaturated carboxylic acids and metal salts thereof), organic fillers (e.g., zinc oxide, barium sulfate, calcium carbonate, titanium oxide), and organic peroxides (e.g., dicumyl peroxide, 1,1-bis(t-butylperoxy)cyclohexane), may be compounded with the base resin. If necessary, additional ingredients, such as commercial antioxidants, may be suitably added as well. The amount of the metal salt of an unsaturated carboxylic acid included per 100 parts by weight of base rubber is preferably from 5 to 40 parts by weight, more preferably from 10 to 30 parts by weight, and even more preferably from 15 to 25 parts by weight. The amount of organic peroxide included per 100 parts by weight of the base rubber is preferably from 0.1 to 5 parts by weight, more preferably from 0.3 to 3 parts by weight, and even more preferably from 0.6 to 2 parts by weight. The amount of inorganic filler included (when two or more inorganic fillers are used, the combined amount thereof) per 100 parts by weight of the base rubber is preferably from 10 to 40 parts by weight, more preferably from 15 to 35 parts by weight, and even more preferably from 20 to 30 parts by weight. If the above ingredients are included in amounts outside of the indicated ranges, the desired hardness, resilience and low cost cannot be achieved while also attaining the desired core whiteness. The objects of the invention can be more easily achieved the closer the color of the core is to white.

As noted above, inorganic fillers such as zinc oxide, calcium carbonate, barium sulfate and titanium oxide may be used in combination. In addition, the inorganic filler may include iron oxide in an amount, based on the respective inorganic fillers, of preferably 0.3 wt % or less, more preferably 0.1 wt % or less, and even more preferably 0.02 wt % or less. If this content is too high, the core may cloud, which may result in a poor ball appearance. To ensure a low cost and the retention of a high resilience, it is preferable to use a combination of the following three types of inorganic fillers: zinc oxide, precipitated barium sulfate and titanium oxide. To minimize chromogenic effects under ultraviolet light exposure, it is preferable for the titanium oxide used to be rutile titanium oxide. Moreover, rutile titanium oxide produced by a chloride process is preferred because it has a blue tinge and does not yellow.

When zinc oxide, precipitated barium sulfate and titanium oxide are all used in the core material, it is preferable from the standpoint of low cost, whiteness and the retention of high resilience for 1 to 5 parts by weight of titanium oxide, 1 to 10 parts by weight of zinc oxide and 10 to 30 parts by weight of precipitated barium sulfate to be included per 100 parts by weight of the base rubber and for the content of zinc oxide to be lower than the content of titanium oxide.

The core diameter may be suitably selected within a core diameter range suitable for a two-piece construction. The numerical range, while not subject to any particular limitation, is generally at least 36 mm, and preferably at least 38 mm, but generally not more than 40 mm, and preferably not more than 39 mm.

The core deflection, defined herein as the deformation by the core when compressed under a final load of 1,275 N (130 kgf) from an initial load state of 98 N (10 kgf), is generally from 2.5 mm to 6.0 mm, preferably from 3.5 mm to 5.5 mm, and more preferably from 4.0 mm to 5.0 mm. If the deformation is too small, the ball may have too hard a feel on impact and the period of contact between the ball and the club face may be too short, resulting in a poor controllability. If the deformation is too large, the ball may have too soft a feel on impact, worsening the durability to cracking on repeated impact.

The core has a surface hardness, expressed as the Shore D hardness, of generally from 28 to 62, preferably from 32 to 54, and more preferably from 35 to 45. The core has a center hardness, expressed as the Shore D hardness, of generally from 28 to 43, preferably from 30 to 40, and more preferably from 32 to 36. If both the core surface and the core center hardness values are too low, the ball may have too hard a feel on impact and the period of contact between the ball and the club face may be too short, resulting in a poor controllability. On the other hand, if the above values are too large, the ball may have too soft a feel and may have a poor durability to cracking on repeated impact. The difference between the core surface hardness and the core center hardness, expressed in Shore D hardness units, is generally from 0 to 15, preferably from 3 to 10, and more preferably from 5 to 8 If the hardness difference is too large or the surface portion is too soft, the durability to cracking on repeated impact may worsen.

In the present invention, the golf ball core has a surface color which, expressed using the Lab color system, has a lightness L value of at least 82 and a chroma C, defined as $(a^2+b^2)^{1/2}$, of 10 or less.

The Lab color system used herein is determined from the following expressions using the tristimulus values X, Y and Z specified in JIS Z8730.

$$L=10Y^{1/2} \quad (1)$$

$$a=17.5(1.02X-Y)/Y^{1/2} \quad (2)$$

$$b=7.0(Y-0.847Z)/Y^{1/2} \quad (3)$$

where L: lightness index in R. S. Hunter's color difference equations a, b: color coordinates in Hunter's color difference equations X, Y, Z: tristimulus values X, Y and Z in XYZ color system In the above Lab color system, L represents lightness and is determined as a value from 100 to 0. "Lightness" refers to the light or dark state of the color; that is, to the degree of luminance. A larger L value signifies greater lightness.

The a and b values indicate perceived color, with the a value representing the red-green direction and the b value representing the yellow-blue direction. A larger a value indicates more intense redness, and a smaller a indicates more intense greenness. A larger b value indicates more intense yellowness, and a smaller b value indicates more intense blueness. The relationship between these a and b values is summarized in Table 1 below.

TABLE 1

| | b | | |
|---|---|---|---|
| a | Minus (−) | Close to zero | Plus (+) |
| Minus (−) | blue | blue-violet | violet |
| Close to zero | green | white/gray/black | red-violet |
| Plus (+) | blue-green | yellow | red |

In the practice of the invention, the core surface color has an L (lightness) value of at least 82, preferably at least 85, and more preferably at least 90. If this value is low, the resulting ball may appear dark. The chroma C, which is defined as $(a^2+b^2)^{1/2}$, is 10 or less, preferably 8 or less, and more preferably 6 or less. If this value is too large, the surface color of the core becomes less white and the color of the overall ball obtained by encasing the core within the cover may worsen.

Next, the cover used in the golf ball of the invention is described. The golf ball cover of the invention is composed of a single layer which directly encases the core and is made primarily of a resin material. A suitable amount of fluorescent pigment selected from the group consisting of yellow, orange, peach and red fluorescent pigments is included in the resin material.

No particular limitation is imposed on the resin material used to form the cover, although a known thermoplastic resin may be suitably selected. The use of an ionomer resin is especially preferred. Also, various types of additives, such as various thermoplastic elastomers and low-molecular-weight polyethylene waxes, may be optionally included, provided the transparency of the cover resin material is not thereby compromised.

The above-described cover resin material includes from 0 to 0.5 part by weight of titanium oxide. In addition, a fluorescent pigment selected from the group consisting of yellow, orange, peach and red may be suitably used in the cover resin material. The amount of fluorescent pigment added per 100 parts by weight of the cover resin material is preferably at least 0.1 part by weight but not more than 2 parts by weight.

When a yellow pigment is used as the fluorescent pigment, the amount of addition is preferably from 1.0 to 2.0 parts by weight; when an orange pigment is used, the amount of addition is preferably from 0.5 to 1.5 parts by weight; when a peach-colored pigment is used, the amount of addition is preferably from 0.1 to 0.5 part by weight; and when a red pigment is used, the amount of addition is preferably from 0.6 to 1.5 parts by weight. At respective amounts of addition lower than those mentioned above, the fluorescent effect is inadequate, as a result of which the intended objects of the invention may not be achieved. On the other hand, addition in respective amounts higher than those mentioned above will not result in a further increase in the fluorescent effect.

The associations between the fluorescent pigments that may be used in the invention and the L value, a value and b value of the ball surface are indicated below.

When the Fluorescent Pigment is Yellow

The ball surface has an L value of preferably at least 90, and more preferably at least 95; an a value of preferably from −50 to 0 and more preferably from −30 to −15; and a b value of preferably from 30 to 80, and more preferably from 50 to 70.

When the Fluorescent Pigment is Orange

The ball surface has an L value of preferably at least 60, and more preferably from 60 to 70; an a value of preferably from 50 to 90 and more preferably from 70 to 80; and a b value of preferably from 10 to 50, and more preferably from 30 to 45.

When the Fluorescent Pigment is Peach

The ball surface has an L value of preferably at least 60, and more preferably from 60 to 70; an a value of preferably from 50 to 90 and more preferably from 65 to 75; and a b value of preferably from −50 to 0, and more preferably from −35 to −20.

When the Fluorescent Pigment is Red

The ball surface has an L value of preferably at least 50, and more preferably from 50 to 60; an a value of preferably from 50 to 90 and more preferably from 60 to 80; and a b value of preferably from 0 to 50, and more preferably from 20 to 30.

If the L value, a value and b value fall outside of the above ranges, the desired hue will be unattainable in each of the colored golf balls. In particular, sufficient ball visibility in poor weather, on snow in the winter, and on dead turf will not be achievable.

The cover has a Shore D hardness of generally from 50 to 66, preferably from 55 to 63, and more preferably from 58 to 60. If the Shore D hardness of the cover is higher than the above range, the durability to repeated impact may decrease and the ball may have a harder feel on impact. On the other hand, if the Shore D hardness of the cover is too low, the rebound may decrease and the spin rate may rise, possibly preventing the ball from traveling as far as desired.

The cover has a thickness of generally from 1.8 to 2.3 mm, preferably from 1.9 to 2.2 mm, and more preferably from 2.0 to 2.1 mm. If the cover is thicker than the above range, the rebound may decrease and the ball may fail to travel as far as desired. On the other hand, if the cover is too thin, the durability of the ball to repeated impact may decrease.

Numerous dimples may be formed on the surface of the cover. The dimples arranged on the cover surface generally number from 300 to 380, preferably from 320 to 360, and more preferably from 325 to 340. If the number of dimples is higher than the above range, the ball will tend to have a low trajectory, which may shorten the distance of travel. On the other hand, if the number of dimples is too small, the ball will tend to have a high trajectory, as a result of which an increased distance may not be achieved. Any one or combination of two or more dimple shapes, including circular shapes, various polygonal shapes, dewdrop shapes and oval shapes, may be suitably used. If circular dimples are used, the diameter of the dimples may be set to from 2.5 to 6.5 mm, and the depth may be set to from 0.08 mm to 0.30 mm. Moreover, the dimples may be suitably selected so as to set the value $V_0$ (the value obtained by dividing the spatial volume of each dimple below the flat plane circumscribed by the edge of that dimple by the volume of a cylinder whose base is the flat plane and whose height is the maximum depth of the dimple from the cylinder base) in a range of from 0.35 to 0.80, the value SR (the sum of the individual dimple surface areas, each defined by the border of the flat plane circumscribed by the edge of the dimple, expressed as a ratio with respect to the spherical surface area of the ball were it to be free of dimples) in a range of from 60 to 90%, and the value VR (the sum of the volumes of individual dimples formed below flat planes circumscribed by the dimple edges, as a percentage of the volume of the ball sphere were it to have no dimples thereon) in a range of from 0.6 to 1. Outside of these ranges, the ball may assume a trajectory that is not conducive to achieving a good distance, as a result of which the ball may fail to travel a sufficient distance when played.

The above dimples are features that form numerous raised and recessed areas on the ball surface. The diameter, number and depth of the dimples exert an influence on the appearance of the ball. Accordingly, it is preferable for the dimples to be configured in such a way as to allow the objects of the invention to be achieved. For example, if the number of dimples is too high, when light strikes the ball, the visibility of the colored ball may be diminished. That is, depending on the angle at which the ball is seen, shadows may form at the bottoms of the dimples, making the ball appear darker. Conversely, if the number of dimples is too low, when the ball is struck, the desired aerodynamic characteristics cannot be achieved, as a result of which the ball may not travel as far as desired.

To increase the distance traveled by a golf ball, it is regarded as desirable for the ball to have a low coefficient of drag CD at high velocity and a high coefficient of lift CL at low velocity. It is preferable to optimize, in the golf ball of the invention when hit, the coefficient of lift CL at a Reynolds number of 70,000 and a spin rate of 2,000 rpm and the coefficient of drag CD at a Reynolds number of 180,000 and a spin rate of 2,520 rpm. This is explained below.

Obtaining a ball which, when hit with a club designed for long shots such as a number one wood (driver), has a long travel distance, is particularly resistant to wind effects and has a good run, requires a suitable balance of lift and drag on the ball that has been hit. This balance depends on the construction of the ball and the materials used in the ball, and also depends on a number of dimple parameters, including the type and total number of dimples, the dimple surface coverage and the total volume of dimples on the ball.

Figure 2:
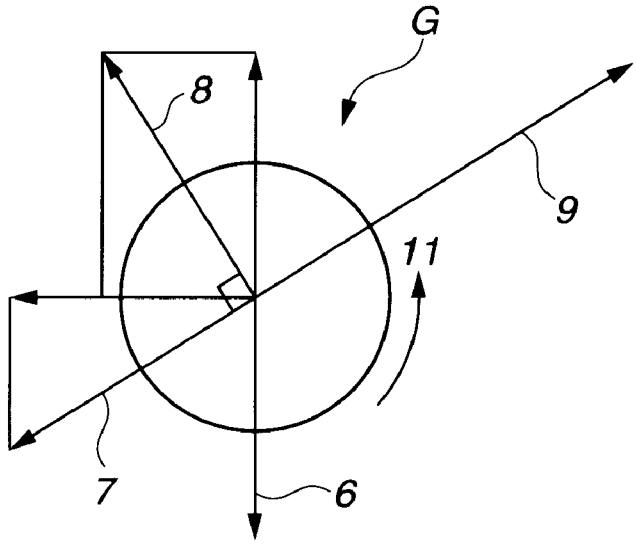
FIG. 2 is a diagram illustrating the relationship between lift and drag on a golf ball in flight.

As shown in FIG. 2, a golf ball G in flight that has been hit by a club is known to incur gravity 6, air resistance (drag) 7, and also lift 8 due to the Magnus effect because the ball has spin. Also indicated in the same diagram are the direction of flight 9 and the direction 11 in which the ball G is spinning.

The forces acting upon the golf ball in this case are represented by the following trajectory equation (1).

$$FL+FD+Mg \quad (1)$$

where F: forces acting upon golf ball

FL: lift

FD: drag

Mg: gravity

The lift FL and drag FD in the trajectory equation (1) are given by formulas (2) and (3) below.

$$FL=0.5\times CL\times\rho\times A\times V^2 \quad (2)$$

$$FD=0.5\times CD\times\rho\times A\times V^2 \quad (3)$$

where CL: coefficient of lift

CD: coefficient of drag

ρ: air density

A: maximum cross-sectional surface area of golf ball

V: air velocity with respect to golf ball

Decreasing the drag or the drag coefficient CD by itself is not very effective for increasing the distance traveled by the ball. Making only the drag coefficient small will extend the position of the ball at the highest point of its trajectory, but in the low-velocity region after the highest point, the ball will drop due to insufficient lift and thus tend to travel a shorter distance.

The golf ball of the invention has a low-velocity CL, which is the coefficient of lift on the ball just after being launched with an Ultra Ball Launcher (UBL) when measured at a Reynolds number of 70,000 and a spin rate of 2,000 rpm, of at least 0.165, preferably at least 0.170, and more preferably at least 0.180. The inventive golf ball has a high-velocity CD, which is the coefficient of drag on the ball just after launch at a Reynolds number of 180,000 and a spin rate of 2,520 rpm, of not more than 0.230, preferably not more than 0.225, and more preferably not more than 0.220. Outside of these ranges, the golf ball cannot achieve a good distance.

A Reynolds number of 180,000 just after the ball is launched corresponds to a ball velocity of about 64 m/s, and a Reynolds number of 70,000 corresponds to a ball velocity of about 25 m/s. The UBL is a device which includes two pairs of drums, one on top and one on the bottom. The drums are turned by belts that extend across the two top drums and across the two bottom drums. The UBL inserts a golf ball between the turning drums and thereby launches the golf ball under the desired conditions. This device is manufactured by Automated Design Corporation.

In the invention, any of various coatings may be applied to the surface of the golf ball cover. Given the need to withstand the demanding conditions of golf ball use, preferred examples include two-part curing urethane coatings, particularly non-yellowing urethane coatings. Moreover, when such a coating is used to elicit luster, should the ball surface become marred, areas lacking luster may arise on the surface, compromising the appearance of the ball.

With regard to the Lab color differences (Hunter Lab color differences) between the color of the ball and the color of the core, the color difference ΔE between the ball color and the core color is computed as follows. That is, the Lab color (L1, a1, b1) for the core and the Lab color (L2, a2, b2) for the ball are each measured. The differences therebetween are then computed (ΔL=L2−L1, Δa=a2−a1, Δb=b2−b1, and the color difference ΔE between the two colors is determined from the following formula.

$$\Delta E=(\Delta L^2+\Delta a^2+\Delta b^2)^{1/2}$$

The color difference ΔE here is preferably at least 40, more preferably at least 50, and even more preferably at least 60. At a color difference ΔE which is too small, the color of the ball is insufficiently light, which may lower the ball visibility.

The ball has a deflection, expressed as the deformation of the ball when compressed under a final load of 1,275 N (130 kgf) from an initial load of 98 N (10 kgf), of generally from 2.3 to 5.0 mm, preferably from 2.8 to 4.0 mm, and more preferably from 3.2 mm to 3.7 mm. If the deformation is too small, the feel on impact may be too hard and the period of contact between the ball and the club face may be too short, which tends to result in a poor controllability. On the other hand, if the deformation is too large, the feel on impact may be too soft and the ball may have a poor durability to cracking on repeated impact.

The ball has an initial velocity of generally at least 76.5 m/s, preferably at least 76.8 m/s, and more preferably at least 77.2 m/s. If the initial velocity is too much lower than these values, the ball may not travel as far as desired. In order to have the ball conform to the standard for official balls according to R&A rules, it is desirable for the upper limit in the initial velocity to be 77.724 m/s.

The inventive golf ball may be manufactured by a method which involves vulcanizing a rubber composition composed primarily of polybutadiene under known vulcanization conditions to form a molded and crosslinked rubber material (core), then forming a cover over the core by a known process such as injection molding.

The golf ball of the invention, which can be manufactured so as to conform with the Rules of Golf for competitive play, may be produced to a ball diameter which is not less than 42.67 mm and to a weight which is not more than 45.93 g.

As described above, the golf ball of the invention, owing to synergistic effects by the surface colors of the core and the cover, enable the ball to be finished to a more brightly fluorescent color than has previously been achieved, thus making the ball conspicuous in poor weather such as when it is snowing, and also giving the ball a high visibility during play. Hence, the ball exhibits a distinctive appearance unlike that of other colored balls. Moreover, the inventive golf ball has a soft feel on impact and possesses ball properties which enable a substantial increase in distance.

EXAMPLES

The following Examples of the invention and Comparative Examples illustrate but do not limit the invention.

Examples 1 to 4, Comparative Examples 1 to 5

Rubber compositions having the properties in Table 2 were prepared, then masticated with a kneader or a roll mill, following which cores were fabricated under specific vulcanizing conditions. The cover resin materials shown in Table 2 were then injection-molded over the core in a mold, thereby giving golf balls according to Examples 1 to 4 of the invention and Comparative Examples 1 to 5.

TABLE 2

| | | Example | | | | Comparative Example | | | | |
|---|---|---|---|---|---|---|---|---|---|---|
| | | 1 | 2 | 3 | 4 | 1 | 2 | 3 | 4 | 5 |
| Cover | Color of cover | yellow | orange | peach | red | yellow | orange | peach | yellow | white |
| | Himilan 1557 (trade name) | 50 | 50 | 50 | 50 | 50 | 50 | 50 | 50 | 50 |
| | Himilan 1601 (trade name) | 50 | 50 | 50 | 50 | 50 | 50 | 50 | 50 | 50 |
| | Titanium oxide | 0.078 | 0 | 0.1 | 0 | 0.078 | 0 | 0.1 | 0.078 | 3 |
| | Fluorescent Yellow pigment | 1.558 | 0 | 0 | 0 | 1.558 | 0 | 0 | 1.558 | 0 |
| | Fluorescent Orange pigment | 0 | 0.98 | 0 | 0 | 0 | 0.98 | 0 | 0 | 0 |
| | Fluorescent Peach pigment | 0 | 0 | 0.22 | 0 | 0 | 0 | 0.22 | 0 | 0 |
| | Fluorescent Red pigment | 0 | 0 | 0 | 1 | 0 | 0 | 0 | 0 | 0 |
| | Low-molecular-weight polyethylene wax | 2 | 2 | 2 | 2 | 2 | 2 | 2 | 2 | 0 |
| | Dispersant, etc. | 0 | 0 | 0 | 0.1 | 0 | 0 | 0 | 0 | 0 |
| | Sheet hardness, Shore D | 60 | 60 | 60 | 60 | 60 | 60 | 60 | 60 | 60 |
| | Gauge (mm) | 2.1 | 2.1 | 2.1 | 2.1 | 2.1 | 2.1 | 2.1 | 2.1 | 2.1 |
| Core | Color of core | white | white | white | white | blue | blue | blue | peach | white |
| | Polybutadiene rubber[1)] | 100 | 100 | 100 | 100 | 100 | 100 | 100 | 100 | 100 |
| | Zinc acrylate | 21 | 21 | 21 | 21 | 21 | 21 | 21 | 21 | 21 |
| | Precipitated barium sulfate[2)] | 20.4 | 20.4 | 20.4 | 20.4 | 20.4 | 20.4 | 20.4 | 20.4 | 20.38 |
| | Titanium oxide[3)] | 2 | 2 | 2 | 2 | 2 | 2 | 2 | 2 | 2 |
| | Peroxide (1)[4)] | 0.6 | 0.6 | 0.6 | 0.6 | 0.6 | 0.6 | 0.6 | 0.6 | 0.6 |
| | Peroxide (2)[5)] | 0.6 | 0.6 | 0.6 | 0.6 | 0.6 | 0.6 | 0.6 | 0.6 | 0.6 |
| | Antioxidant[6)] | 0.1 | 0.1 | 0.1 | 0.1 | 0.1 | 0.1 | 0.1 | 0.1 | 0.1 |
| | Zinc oxide | 5 | 5 | 5 | 5 | 5 | 5 | 5 | 5 | 5 |
| | Organosulfur compound[7)] | 0.1 | 0.1 | 0.1 | 0.1 | 0.1 | 0.1 | 0.1 | 0.1 | 0.1 |
| | Red pigment[8)] | 0 | 0 | 0 | 0 | 0 | 0 | 0 | 0.05 | 0 |
| | Blue pigment[9)] | 0 | 0 | 0 | 0 | 0.025 | 0.025 | 0.025 | 0 | 0 |
| | Vulcanization method | vulcanized at 160° C. for 15 minutes in all cases | | | | | | | | |

[1)]Polybutadiene rubber produced by JSR Corporation under the trade name "BR01"
[2)]Produced by Sakai Chemical Industry Co., Ltd. under the trade name "Precipitated Barium Sulfate #100"
[3)]Rutile type (chloride process) produced by Huntsman under the trade name "Tioxide TR93"
[4)]Peroxide (1) was dicumyl peroxide produced by NOF Corporation under the trade name "Percumyl D"
[5)]Peroxide (2) was 1,1-bis(t-butylperoxy)-3,3,5-trimethyl-cyclohexane produced by NOF Corporation under the trade name "Perhexa 3M-40"
[6)]Produced by Ouchi Shinko Chemical Industry Co., Ltd. under the trade name "Nocrac NS-6"
[7)]Zinc salt of pentachlorothiophenol
[8)]Produced by Resino Color Industry Co., Ltd. under the trade name "Resino Red K"
[9)]Produced by Resino Color Industry Co., Ltd. under the trade name "Resino Red RT-K"

The cover material is described below. Numbers in the table indicate the proportions of the respective ingredients in parts by weight per 100 parts by weight of the resin material.

Himilan (Trade Name):

Ionomer resins produced by DuPont-Mitsui Polychemicals Co., Ltd.

Low-Molecular-Weight Polyethylene Wax:

Produced by Sanyo Chemical Industries, Ltd. under the trade name "Sanwax 161-P"

The core formulation is described below. Numbers in the table indicate the proportions of the respective ingredients in parts by weight per 100 parts by weight of the polybutadiene rubber.

Dimple Characteristics

The dimples described below were used in the examples of the invention and the comparative examples.

TABLE 3

Figure 3:
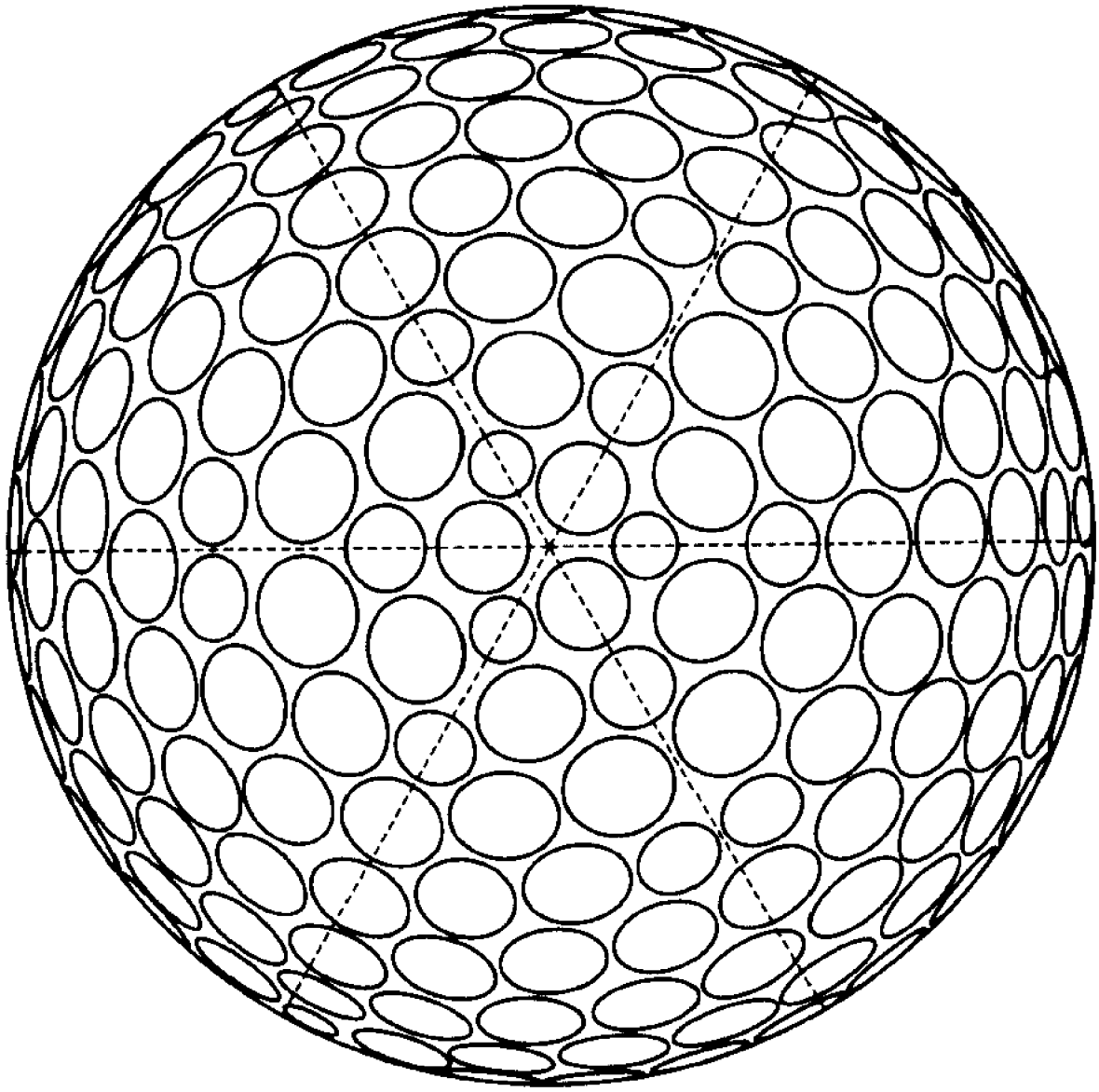
FIG. 3 is a top view of a ball showing the arrangement of dimples used in the examples of the invention and the comparative examples.

| | No. | Number of dimples | Diameter (mm) | Depth (mm) | $V_0$ | SR (%) | VR (%) | Total dimple volume ($mm^3$) | Diagram of dimple arrangement |
|---|---|---|---|---|---|---|---|---|---|
| I | 1 | 12 | 4.573 | 0.138 | 0.481 | 79.8 | 0.757 | 308 | FIG. 3 |
| | 2 | 198 | 4.370 | 0.135 | 0.487 | | | | |
| | 3 | 36 | 3.799 | 0.127 | 0.480 | | | | |
| | 4 | 6 | 3.450 | 0.135 | 0.472 | | | | |

TABLE 3-continued

| No. | Number of dimples | Diameter (mm) | Depth (mm) | $V_0$ | SR (%) | VR (%) | Total dimple volume ($mm^3$) | Diagram of dimple arrangement |
|---|---|---|---|---|---|---|---|---|
| 5 | 12 | 2.687 | 0.110 | 0.453 | | | | |
| 6 | 36 | 4.406 | 0.171 | 0.479 | | | | |
| 7 | 24 | 3.822 | 0.161 | 0.468 | | | | |
| 8 | 6 | 3.278 | 0.132 | 0.460 | | | | |
| Total | 330 | | | | | | | |

Dimple Definitions

Diameter: Diameter of flat plane circumscribed by edge of dimple.

Depth: Maximum depth of dimple from flat plane circumscribed by dimple edge.

$V_0$: Value obtained by dividing spatial volume of each dimple below the flat plane circumscribed by the edge of the dimple by the volume of a cylinder whose base is the flat plane and whose height is the maximum depth of the dimple from the cylinder base.

SR: Sum of individual dimple surface areas, each defined by the border of the flat plane circumscribed by the edge of the dimple, expressed as a ratio with respect to the spherical surface area of the ball were it to be free of dimples.

VR: Sum of the volumes of individual dimples formed below flat planes circumscribed by dimple edges, as a percentage of the volume of the ball sphere were it to have no dimples thereon.

Aerodynamic Properties (Low-Velocity CL, High-Velocity CD)

The low-velocity CL ratio was determined by calculating the coefficient of lift CL for the ball when launched at a Reynolds number of 70,000 and a spin rate of 2,000 rpm using an Ultra Ball Launcher (UBL). The high-velocity CD was similarly obtained by measuring the drag coefficient for the ball when launched at a Reynolds number of 180,000 and a spin rate of 2,520 rpm. These values are shown below.

TABLE 4

| | | | |
|---|---|---|---|
| Aerodynamic properties | Re 70,000/2,000 rpm | low-velocity CD | 0.233 |
| | | low-velocity CL | 0.191 |
| | Re 180,000/2,520 rpm | high-velocity CD | 0.218 |
| | | high-velocity CL | 0.166 |

The UBL is a device which includes two pairs of drums, one on top and one on the bottom. The drums are turned by a belt across the two top drums and a belt across the two bottom drums. The UBL inserts a golf ball between the turning drums and launches the golf ball under the desired conditions. This device is manufactured by Automated Design Corporation.

The properties of the core and the golf balls obtained in the respective examples of the invention and comparative examples were measured according the following criteria. The results are given in Table 5.

Core Deflection

The deformation (mm) by the core when compressed under a final load of 1,275 N (130 kgf) from an initial load state of 98 N (10 kgf) was measured.

Shore D Hardness at Core Surface and Core Center

Both hardnesses were measured in terms of the Shore D hardness (using a type D Durometer according to ASTM-2240).

The surface hardness was a value measured with the durometer set vertically on the surface of the core.

The center hardness was a value measured at the center portion of the cut face of a hemisphere obtained by cutting the core in half.

Color of Core

The color of the core in the Lab color system was measured using a color difference meter manufactured by Suga Test Instruments Co., Ltd.

Ball Deflection

The deformation (mm) by the ball when compressed under a final load of 1,275 N (130 kgf) from an initial load state of 98 N (10 kgf) was measured.

Initial Velocity

The initial velocity was measured using an initial velocity measuring apparatus of the same type as the USGA drum rotation-type initial velocity instrument approved by the R&A. The ball was temperature conditioned at 23±1° C. for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity of the ball. This cycle was carried out over a period of about 15 minutes. The results are shown in Table 2.

Flight Performance

The total distance traveled by the ball when hit at a head speed (HS) of 35 m/s with a driver (trade name: "Tour Stage V36"; loft angle, 10.5°; shaft, R) mounted on a swing robot was measured. The flight performance was rated according to the following criteria.

Good: Total distance of travel was at least 165 m

NG: Total distance of travel was less than 165 m

Feel

Sensory evaluations were carried out with a panel of ten amateur women golfers having head speeds of 30 to 40 m/s. Ratings were based on the following criteria.

Good: At least 7 of the 10 golfers thought the ball had a good feel.

Fair: Between 4 and 6 of the 10 golfers thought the ball had a good feel.

NG: Three or fewer of the 10 golfers thought the ball had a good feel.

Ball Appearance (1) Acceptability of Ball Appearance

Sensory evaluations by ten women golfers.

Good: At least 7 of the 10 golfers felt the ball was attractive.

Fair: Six of the 10 golfers felt the ball was attractive.

NG: Five or fewer of the 10 golfers felt the ball was attractive.

(2) Ease of Finding Ball

Sensory evaluations by ten women golfers.

Very Good (VG): Very easy to find. (At least 8 of the 10 golfers felt the ball was easy to find.)

Good: Easy to find. (Between 5 and 7 of the 10 golfers felt the ball was easy to find.)

Fair: Somewhat difficult to find. (Three or four of the 10 golfers felt the ball was easy to find.)

NG: Very difficult to find. (Two or fewer of the 10 golfers felt the ball was easy to find.)

TABLE 5

| | | Example | | | | Comparative Example | | | | |
|---|---|---|---|---|---|---|---|---|---|---|
| | | 1 | 2 | 3 | 4 | 1 | 2 | 3 | 4 | 5 |
| Core color | L1 (lightness) | 97.3 | 97.3 | 97.3 | 97.3 | 64.5 | 64.5 | 64.5 | 66.8 | 97.3 |
| | a1 | −1.7 | −1.7 | −1.7 | −1.7 | −7.9 | −7.9 | −7.9 | 37.2 | −1.7 |
| | b1 | 3.7 | 3.7 | 3.7 | 3.7 | −30.4 | −30.4 | −30.4 | 3.1 | 3.7 |
| | C1 (chroma) | 4.0 | 4.0 | 4.0 | 4.0 | 31.4 | 31.4 | 31.4 | 37.4 | 4.0 |
| Core properties | Diameter (mm) | 38.55 | 38.55 | 38.55 | 38.55 | 38.55 | 38.55 | 38.55 | 38.55 | 38.55 |
| | Weight (g) | 35.5 | 35.5 | 35.5 | 35.5 | 35.5 | 35.5 | 35.5 | 35.5 | 35.5 |
| | Deflection (mm) | 4.6 | 4.6 | 4.6 | 4.6 | 4.6 | 4.6 | 4.6 | 4.6 | 4.6 |
| | Core surface (Shore D hardness) | 40 | 40 | 40 | 40 | 40 | 40 | 40 | 40 | 40 |
| | Core center (Shore D hardness) | 34 | 34 | 34 | 34 | 34 | 34 | 34 | 34 | 34 |
| | Hardness difference (core surface − core center) | 6 | 6 | 6 | 6 | 6 | 6 | 6 | 6 | 6 |
| Ball | Diameter (mm) | 42.7 | 42.7 | 42.7 | 42.7 | 42.7 | 42.7 | 42.7 | 42.7 | 42.7 |
| | Weight (g) | 45.4 | 45.4 | 45.4 | 45.4 | 45.4 | 45.4 | 45.4 | 45.4 | 45.6 |
| | Deflection (mm) | 3.7 | 3.7 | 3.7 | 3.7 | 3.7 | 3.7 | 3.7 | 3.7 | 3.7 |
| | Initial velocity (m/s) | 77.3 | 77.3 | 77.3 | 77.3 | 77.3 | 77.3 | 77.3 | 77.3 | 77.3 |
| Ball color | Color tone (cover color) | yellow | orange | peach | red | yellow | orange | peach | yellow | white |
| | L2 (lightness) | 97.3 | 64.2 | 65.7 | 51.3 | 87.2 | 51.3 | 60.1 | 88.8 | 95.1 |
| | a2 | −24.0 | 77.2 | 71.0 | 77.6 | −30.0 | 47.2 | 53.0 | −18.4 | 0.1 |
| | b2 | 60.0 | 38.5 | −27.1 | 25.9 | 52.0 | 27.9 | −32.9 | 53.3 | −7.6 |
| Color difference | ΔL (L2 − L1) | 0.0 | −33.1 | −31.6 | −46.0 | 22.7 | −13.2 | −4.4 | 22.0 | −2.2 |
| | Δa (a2 − a1) | −22.3 | 78.9 | 72.6 | 79.2 | −22.1 | 55.0 | 60.8 | −55.7 | 1.8 |
| | Δb (b2 − b1) | 56.3 | 34.8 | −30.8 | 22.3 | 82.4 | 58.3 | −2.6 | 50.2 | −11.3 |
| | ΔE | 60.6 | 92.4 | 85.0 | 94.2 | 88.3 | 81.2 | 61.0 | 78.1 | 11.6 |
| Flight performance | | good | good | good | good | good | good | good | good | good |
| Feel on impact | | good | good | good | good | good | good | good | good | good |
| Ball appearance | Acceptability of ball appearance | good | good | good | good | NG | NG | NG | NG | good |
| | Ease of finding ball: On snow | good | good | good | good | good | good | good | good | NG |
| | Ease of finding ball: At a distance | good | good | good | good | fair | fair | fair | fair | VG |

$C1 = (a1^2 + b1^2)^{1/2}$

The invention claimed is:

1. A two-piece golf ball comprising a single-layer core, a single-layer cover and a surface on which a plurality of dimples are formed, wherein the cover is made of a material comprising 100 parts by weight of a resin material, from 0 to 0.5 part by weight of titanium oxide, and from 0.1 to 2 parts by weight of a fluorescent pigment selected from the group consisting of yellow, orange, peach and red, and wherein the ball surface has a lightness L value, expressed in the Lab color system, of at least 50 and the core surface has an L value of at least 82 and a chroma C, defined as $(a^2+b^2)^{1/2}$, of 10 or less.

2. The golf ball of claim 1, wherein the core is made of a rubber composition comprising 100 parts by weight of a base rubber having a cis-1,4-polybutadiene content of at least 40 wt%, from 5 to 40 parts by weight of a metal salt of an unsaturated carboxylic acid, from 0.1 to 5 parts by weight of an organic peroxide, and from 10 to 40 parts by weight of an inorganic filler.

3. The golf ball of claim 1, wherein the core contains rutile-type titanium oxide.

4. The golf ball of claim 1, wherein the core is white.

5. The golf ball of claim 2, wherein the inorganic filler present in the core is a combination of zinc oxide, precipitated barium sulfate, and titanium oxide.

6. The golf ball of claim 1, wherein the core is made of a material which includes from 1 to 5 parts by weight of titanium oxide, from 1 to 10 parts by weight of zinc oxide and from 10 to 30 parts by weight of precipitated barium sulfate per 100 parts by weight of the base rubber, and the amount of zinc oxide is lower than the amount of titanium oxide.

7. The golf ball of claim 1, wherein the cover has a material hardness, expressed as the Shore D hardness, of from 50 to 65, and a thickness of at least 12 mm.

8. The golf ball of claim 1, wherein the fluorescent pigment included in the cover and the L value of the ball to surface satisfy one of the following conditions:

(I) the fluorescent pigment has an orange color and the ball surface has an L value of at least 60;

(II) the fluorescent pigment has a peach color and the ball surface has an L value of at least 60;

(III) the fluorescent pigment has a yellow color and the ball surface has an L value of at least 90;

(IV) the fluorescent pigment has a red color and the ball surface has an L value of at least 50.

9. The golf ball of claim 1, wherein the ball, when hit, has a coefficient of lift CL at a Reynolds number of 70,000 and a spin rate of 2,000 rpm that is at least 0.165, and a coefficient of drag CD at a Reynolds number of 180,000 and a spin rate of 2,520 rpm of at most 0.230.

10. The golf ball of claim 1, wherein a deflection of the single-layer core, defined herein as the deformation by the core when compressed under a final load of 1,275 N (130 kgf) from an initial load state of 98 N (10 kgf), is from 2.5 mm to 6.0 mm.

11. The golf ball of claim 1, wherein the core has a surface hardness, expressed as the Shore D hardness, from 28 to 62.

12. The golf ball of claim 1, wherein the core has a center hardness, expressed as the Shore D hardness, from 28 to 43.

13. The golf ball of claim 1, wherein the difference between the core surface hardness and the core center hardness, expressed in Shore D hardness units, is from 0 to 15.

14. The golf ball of claim 1, wherein the fluorescent pigment included in the cover and the L value of the ball surface satisfy any one of the following conditions:

(I) the fluorescent pigment has an orange color and the ball surface has an L value of from 60 to 70;

(II) the fluorescent pigment has a peach color and the ball surface has an L value of from 60 to 70;

(III) the fluorescent pigment has a yellow color and the ball surface has an L value of at least 90;

(IV) the fluorescent pigment has a red color and the ball surface has an L value of from 50 to 60.

* * * * *